US010006749B2

(12) United States Patent
Rodriguez

(10) Patent No.: US 10,006,749 B2
(45) Date of Patent: Jun. 26, 2018

(54) ERGONOMIC CARRIER FOR FIREARM MAGAZINES

(71) Applicant: Adam S. Rodriguez, Sahuarita, AZ (US)

(72) Inventor: Adam S. Rodriguez, Sahuarita, AZ (US)

( * ) Notice: Subject to any disclaimer, the term of this patent is extended or adjusted under 35 U.S.C. 154(b) by 154 days.

(21) Appl. No.: 15/072,806

(22) Filed: Mar. 17, 2016

(65) Prior Publication Data

US 2016/0273899 A1 Sep. 22, 2016

Related U.S. Application Data

(60) Provisional application No. 62/135,307, filed on Mar. 19, 2015.

(51) Int. Cl.

| | |
|---|---|
| ***F42B 39/00*** | (2006.01) |
| ***F42B 39/02*** | (2006.01) |
| ***A45F 5/02*** | (2006.01) |

(52) U.S. Cl.

CPC ..... *F42B 39/02* (2013.01); *A45F 5/021* (2013.01); *A45F 2200/0566* (2013.01); *A45F 2200/0591* (2013.01)

(58) Field of Classification Search

CPC .... A45F 3/005; A45F 5/021; A45F 2003/144; F42B 39/00

USPC ..... 224/682, 660, 914, 931

See application file for complete search history.

(56) References Cited

U.S. PATENT DOCUMENTS

| | | | | |
|---|---|---|---|---|
| 3,938,717 A * | 2/1976 | Theodore | F41A 9/63 | 206/350 |
| 4,120,109 A | 10/1978 | Musgrave | | |
| 4,264,024 A * | 4/1981 | Harris, Jr. | A24F 9/14 | 131/260 |
| 5,174,482 A * | 12/1992 | Rogers | F42B 39/02 | 221/185 |
| 5,201,445 A * | 4/1993 | Axelman | A45F 5/02 | 224/148.6 |
| 5,303,860 A * | 4/1994 | Serafini, Jr. | F41C 33/0218 | 220/324 |
| 5,533,657 A * | 7/1996 | Rosen | A45F 5/02 | 224/191 |
| 5,617,582 A * | 4/1997 | Burwell | A41D 13/0012 | 2/102 |

(Continued)

*Primary Examiner* — Brian D Nash

(74) *Attorney, Agent, or Firm* — Grossman Tucker Perreault & Pfleger PLLC

(57) ABSTRACT

This disclosure is directed to an ergonomic carrier for firearm magazines. An example device may comprise at least first receptacle to receive a first firearm magazine and a second receptacle to receive a second firearm magazine. The first receptacle may include a first lengthwise dimension and may be arranged at a first angle rotated around the first lengthwise dimension. The second receptacle may include a second lengthwise dimension and may be arranged at a second angle formed between the first lengthwise dimension and the second lengthwise dimension, and at a third angle rotated around the second lengthwise dimension. In at least one embodiment, the first and second receptacles may further include retention features to retain the first and second firearm magazines and/or indexing features to train and/or remind a user regarding proper indexing. The device may further include an attachment so that it may be worn by the user.

18 Claims, 6 Drawing Sheets

(56) References Cited

U.S. PATENT DOCUMENTS 5,699,943 A * 12/1997 Schaefer ..... A45F 5/02 16/335
5,894,976 A * 4/1999 Harper ..... A45F 5/00 224/198
6,050,464 A * 4/2000 Ramsey, Sr. ..... F41A 9/61 206/3
6,154,997 A * 12/2000 Aluotto ..... F41C 33/02 224/239
6,202,908 B1 * 3/2001 Groover ..... F42B 39/02 224/236
6,843,399 B2 * 1/2005 Garcia ..... F42B 39/02 224/665
D574,147 S * 8/2008 Zusman ..... D3/222
7,657,977 B2 * 2/2010 Clifton, Jr. ..... A45F 5/02 224/271
7,818,034 B2 * 10/2010 Richards ..... A45F 5/02 379/447
7,918,371 B2 * 4/2011 Wilson ..... F42B 39/02 224/196
8,104,656 B1 * 1/2012 George ..... A45F 5/021 224/239
8,215,525 B2 7/2012 Rassias
8,322,065 B2 * 12/2012 Faifer ..... F42B 39/02 206/3
8,733,606 B2 5/2014 Felts
8,887,972 B2 * 11/2014 Solomon ..... A45F 5/02 224/245
8,887,977 B2 * 11/2014 Ralph ..... F42B 39/02 224/245
D749,843 S * 2/2016 Faifer ..... D3/262
9,395,153 B2 * 7/2016 Bottrell ..... F41A 9/24
9,448,050 B1 * 9/2016 Barwin ..... F42B 39/08
9,549,606 B1 * 1/2017 Casadesus ..... A45F 5/021
9,581,421 B2 * 2/2017 Sitz ..... F42B 39/08
2004/0222258 A1 * 11/2004 Ho ..... A45F 5/022 224/191
2004/0226972 A1 11/2004 Cook
2007/0278269 A1 12/2007 Rogers et al.
2010/0243690 A1 * 9/2010 Lerch ..... A45F 5/02 224/198
2011/0107645 A1 * 5/2011 Faifer ..... F41A 9/63 42/90
2014/0053385 A1 * 2/2014 Nielsen-Cole ..... A45F 5/021 29/426.1
2014/0075650 A1 * 3/2014 Garrison ..... A45F 5/021 2/300
2014/0252053 A1 9/2014 Rogers

* cited by examiner

Device 100

Example 400

ERGONOMIC CARRIER FOR FIREARM MAGAZINES

PRIORITY

The present U.S. non-provisional patent application claims the benefit of U.S. provisional patent application 62/135,307 entitled, "Ergonomic Carrier for Firearm Magazines" and filed on Mar. 19, 2015. The contents of the above-identified provisional patent application, in entirety, are incorporated by reference herein.

TECHNICAL FIELD

This disclosure relates to a carrier system, and more particularly, to a firearm magazine carrier facilitating fast and fluid firearm rearming without having to break focus on a target.

BACKGROUND

Professionals that must carry a firearm (e.g., a handgun) in the performance of their duty are often confronted with dangerous situations. For example, law enforcement officers, military personnel, security providers, etc. may carry a sidearm to protect themselves and others. If other more peaceful measures fail, situations may arise where the sidearm must be drawn and possibly discharged. Professionals are trained to discharge their sidearm only when required, and when required, to do so quickly, accurately and only to the degree necessary based on the situation. As would be expected, a major part of this training may deal with improving shooting skills so that the professional may only hit what is intended. However, the ability to fire a weapon accurately is only part of the equation. Actual enforcement and/or protection situations may be variable, unpredictable, etc., and thus, a professional must be ready to handle whatever is thrown at them.

For example, when engaged in a confrontation wherein a firearm must be drawn and then directed at a target, it is important for the professional to not lose focus of the target at any point. In such an instance walking, talking to an alleged perpetrator, giving orders, reloading a firearm, etc. cannot be allowed interfere with the action taking place and the professional's focus on the target. Training that is provided to professionals may provide proper procedure, repetition, etc. for performing normal tasks during a confrontation so that it becomes habitual. However, it may be some time after training before these skills are employed, if ever, and over this long duration the professional may lose their good habits. Moreover, when confronted with a situation where a firearm must be drawn, heightened tension, adrenaline, a bad environment, fear, etc. may disrupt the concentration of the professional. Performing a simple task such as reloading a firearm (e.g., replacing an empty magazine with a full magazine taken from an auxiliary magazine carrier that may be worn by the professional) may be made more difficult regardless of any training that may have been provided to the professional. If a task like reloading a firearm forces the professional to break focus on a target, then calamity may ensue for the professional or the public at large.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

Although the following Detailed Description will proceed with reference being made to illustrative embodiments, many alternatives, modifications and variations thereof will be apparent to those skilled in the art.

DETAILED DESCRIPTION

This disclosure is directed to an ergonomic carrier for firearm magazines. In at least one embodiment, an example device (e.g., carrier) may comprise at least first receptacle to receive a first firearm magazine and a second receptacle to receive a second firearm magazine. The first receptacle may include a first lengthwise dimension and may be arranged at a first angle rotated around the first lengthwise dimension. The second receptacle may include a second lengthwise dimension and may be arranged at a second angle formed between the first lengthwise dimension and the second lengthwise dimension, and at a third angle rotated around the second lengthwise dimension. The first and second receptacles may further include features that may improve the performance of the carrier and/or a user of the carrier. In at least one embodiment, the first and second receptacles may comprise retention features to more securely retain the first and second firearm magazines. The first and second receptacles may further comprise indexing features to train and/or remind a user of the carrier of proper finger indexing for use in replacing a firearm magazine. The carrier may further comprise an attachment so that it may be worn by the user.

Figure 1:
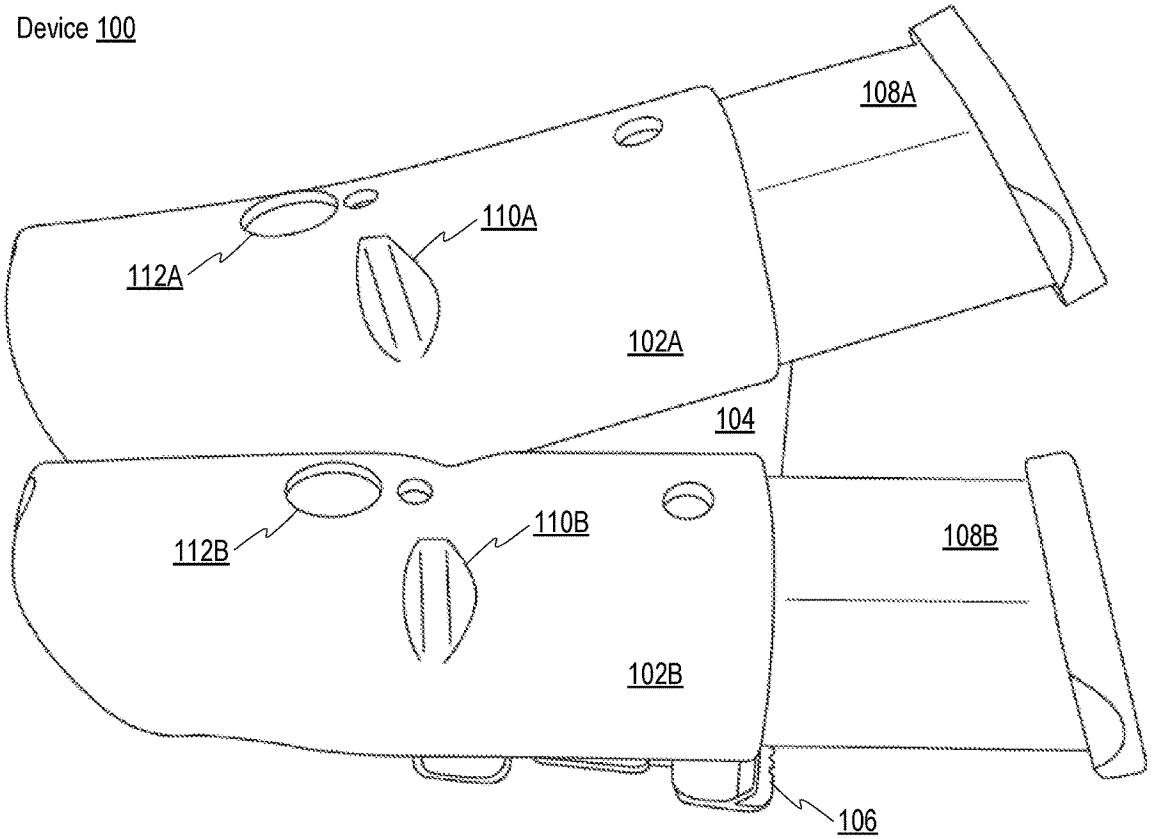
FIG. 1 illustrates an example ergonomic carrier for firearm magazines in accordance with at least one embodiment of the present disclosure.

FIG. 1 illustrates an example ergonomic carrier for firearm magazines in accordance with at least one embodiment of the present disclosure. Initially, the terminology "firearm magazine," as referenced herein, may refer to a removable holder for bullets (e.g., ammunition or "rounds") that may be inserted into an automatic firearm such as an automatic handgun or rifle to reload the firearm. Firearm magazine may be utilized interchangeably herein with the terms "magazine" or "clip." The embodiments disclosed herein will be based on device 100. In general, device 100, along with the corresponding examples and implementations that will be disclosed with respect to FIG. 2-6, have been presented herein merely for the sake of explaining various embodiments of the disclosure. The components of device 100 may vary (e.g., may be added, reconfigured, repositioned, omitted, etc.) consistent with the various embodiments of the present disclosure.

Device 100 may be, in general, a device that may be worn by a user. The device may be configured to hold one or more magazines. For example, a law enforcement officer may utilize device 100 to hold auxiliary magazines should the law enforcement officer need to reload his/her sidearm (e.g., automatic handgun). Device 100 is illustrated in FIG. 1 as comprising at least two receptacles 102A and 102B. While only two receptacles 102A and 102B are shown, less or more receptacles may be included in device 100 based on, for example, the particular application for which device 100 is intended, the job in which a user of device 100 is employed, the preference of a user of device 100, etc. Receptacles 102A and 102B may be coupled to base 104. At least one important characteristic of device 100 are the angles at which receptacles 102A and 102B are mounted on base 104. These angles help to facilitate a user being able to properly index their hand/fingers to remove magazines 108A and 108B from receptacles 102A and 102B in a quick and smooth manner, and without having to lose focus of a target at which the firearm of the user may be directed. Specific examples of these angles will be discussed in regard to FIGS. 2 and 3. An attachment 106 may be coupled to base 104 to allow, for example, a user to wear device 100. Receptacles 102A and 102B may be made using materials such as, but not limited to, plastics, leather, textiles or composites thereof. In at least one embodiment, receptacles 102A and 102B may be made using heat-formable plastic. Base 104 and attachment 106 may be constructed from materials such as, but not limited to, plastic, wood, metal, leather or composites thereof. Moreover, while receptacles 102A and 102B, base 104 and attachment 106 are shown as distinct components that may be coupled together to form device 100, any or all of the components may be formulated together as a single unit. For example, receptacles 102A and 102B may be formed (e.g., machined, injection molded, etc.) as a single unit with or without attachment 106, and thus, device 100 may not require the inclusion of a separate base 104 and/or separate attachment 106.

Receptacles 102A and 102B may comprise features (e.g., modifications, additions, etc.) that may assist in improving the performance of device 100 and/or a user of device 100. For example, receptacles 102A and 102B may comprise retention features 110A and 110B to retain magazines 108A and 108B. During active duty a user of device 100 may experience different sitting/standing positions, walking, running, physical exertion in regard to apprehending and/or restraining a suspect, etc. Retention features 110A and 110B may help make sure that magazines 108A and 108B remain inserted in receptacles 102A and 102B until intentionally removed by the user. While retention features 110A and 110B are shown as indentations in FIG. 1, embodiments consistent with the present disclosure may also comprise other retention features comprising, but not limited to, material applied to an interior surface such tape, cloth, foam, rubber, etc. that may provide a frictional retention force to a surface of magazines 108A and 108B. Receptacles 102A and 102B may further comprise indexing features 112A and 112B. Indexing features 112A and 112B may serve as tactile guides, reminders, etc. for proper finger and/or hand positioning when withdrawing magazine 108A or 108B from receptacle 102A or 102B, respectively. Similar to retention features 110A and 110B, while indexing features 112A and 112B have been shown in FIG. 1 to be holes formed in the surface of receptacles 102A and 102B, respectively, consistent with the present disclosure other indexing features 112A and 112B may be possible such as, for example, a ridge, indentation or another addition and/or modification identifiable through touch.

Figure 2:
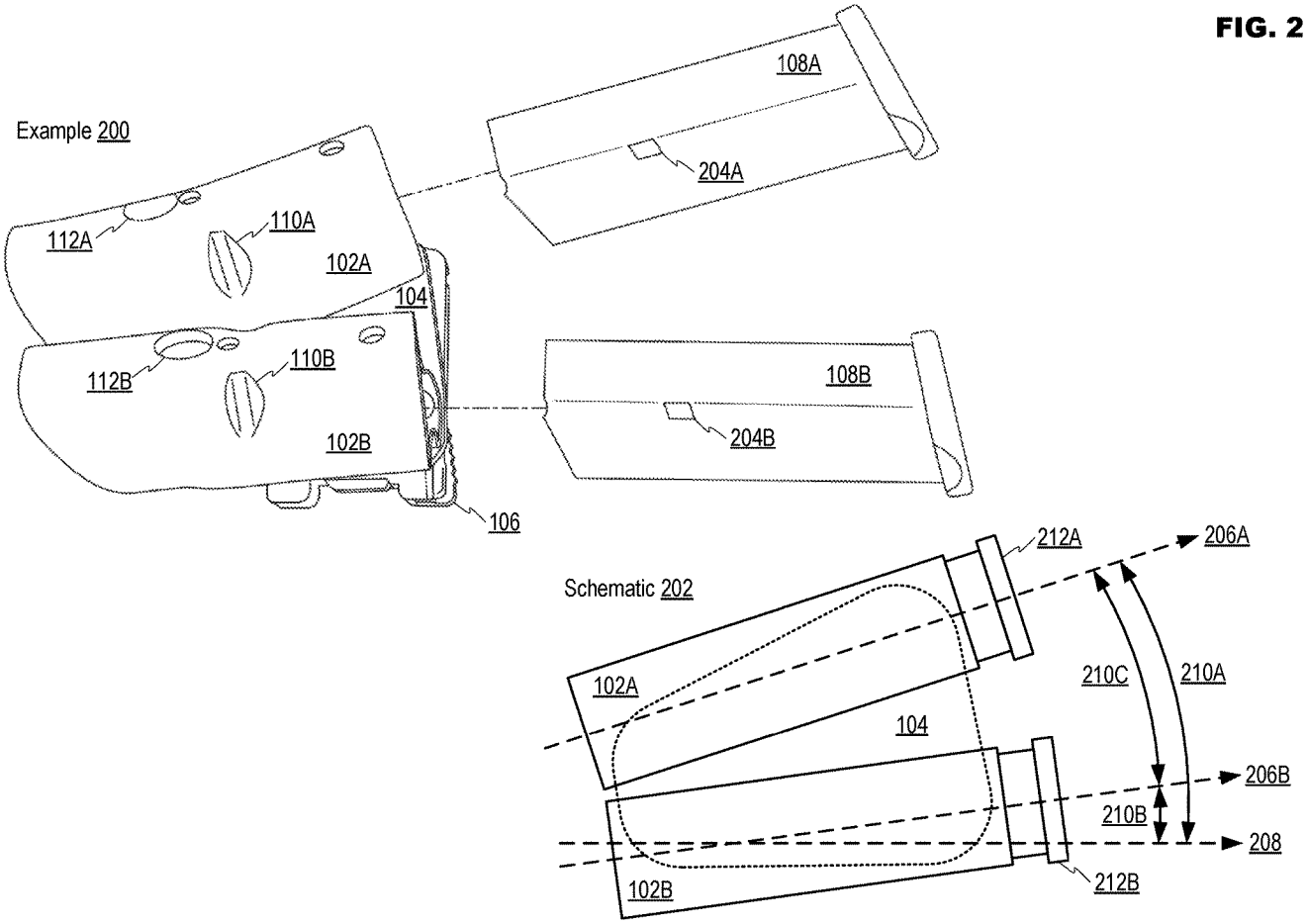
FIG. 2 illustrates an example of firearm magazines withdrawn and a corresponding schematic diagram in accordance with at least one embodiment of the present disclosure.

FIG. 2 illustrates an example of firearm magazines withdrawn and a corresponding schematic diagram in accordance with at least one embodiment of the present disclosure. In example 200 magazines 108A and 108*b* are shown extracted from receptacles 102A and 102B. Indentation 204A and 204B in the surface of magazines 108A and 108B may be designed to retain magazines 108A and 108B in a firearm, but in this instance may also engage or mate with retention features 110A and 110B to retain magazines 108A and 108B in receptacles 102A and 102B, respectively.

Figure 5:
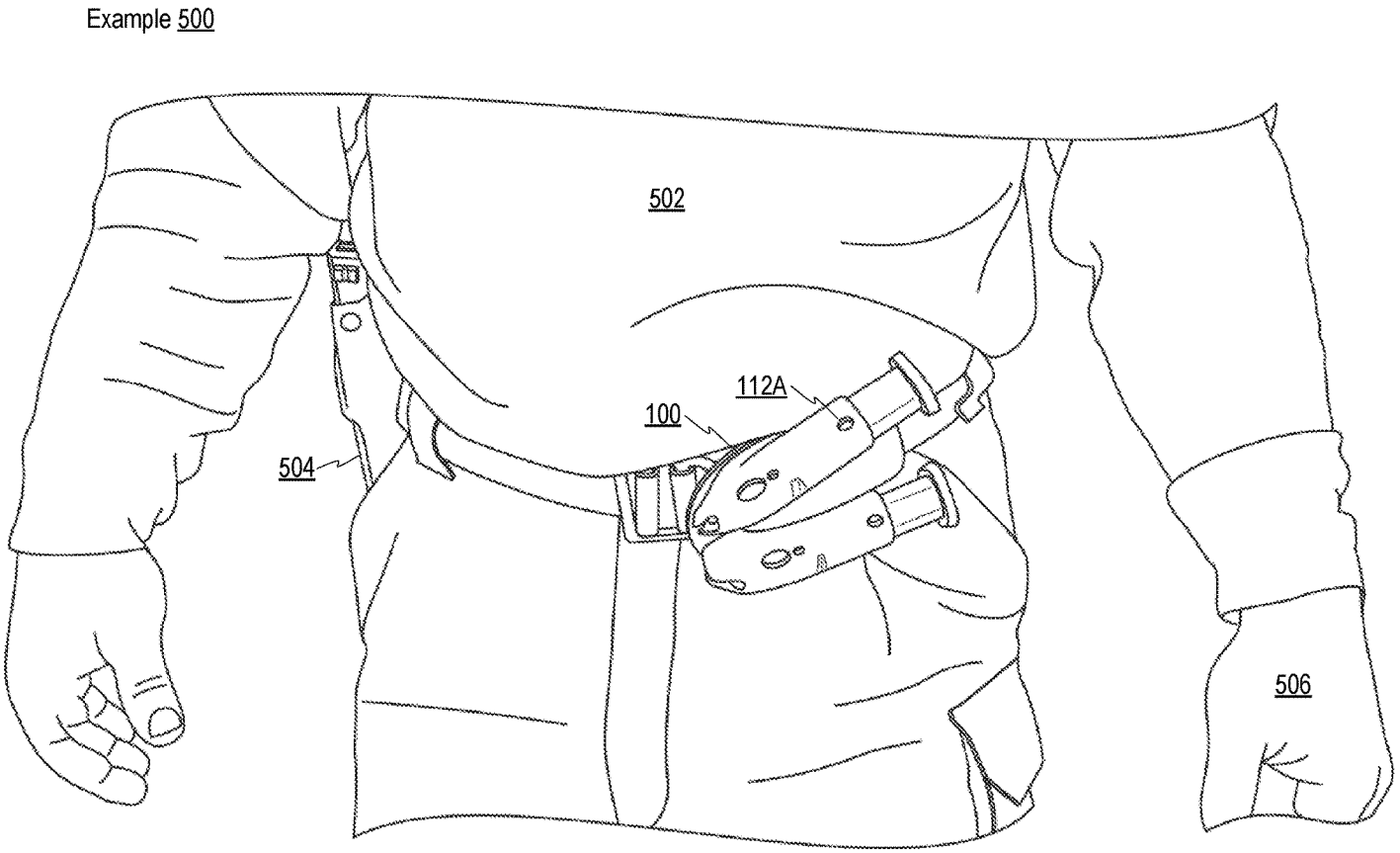
FIG. 5 illustrates a first utilization example in accordance with at least one embodiment of the present disclosure.
Figure 6:
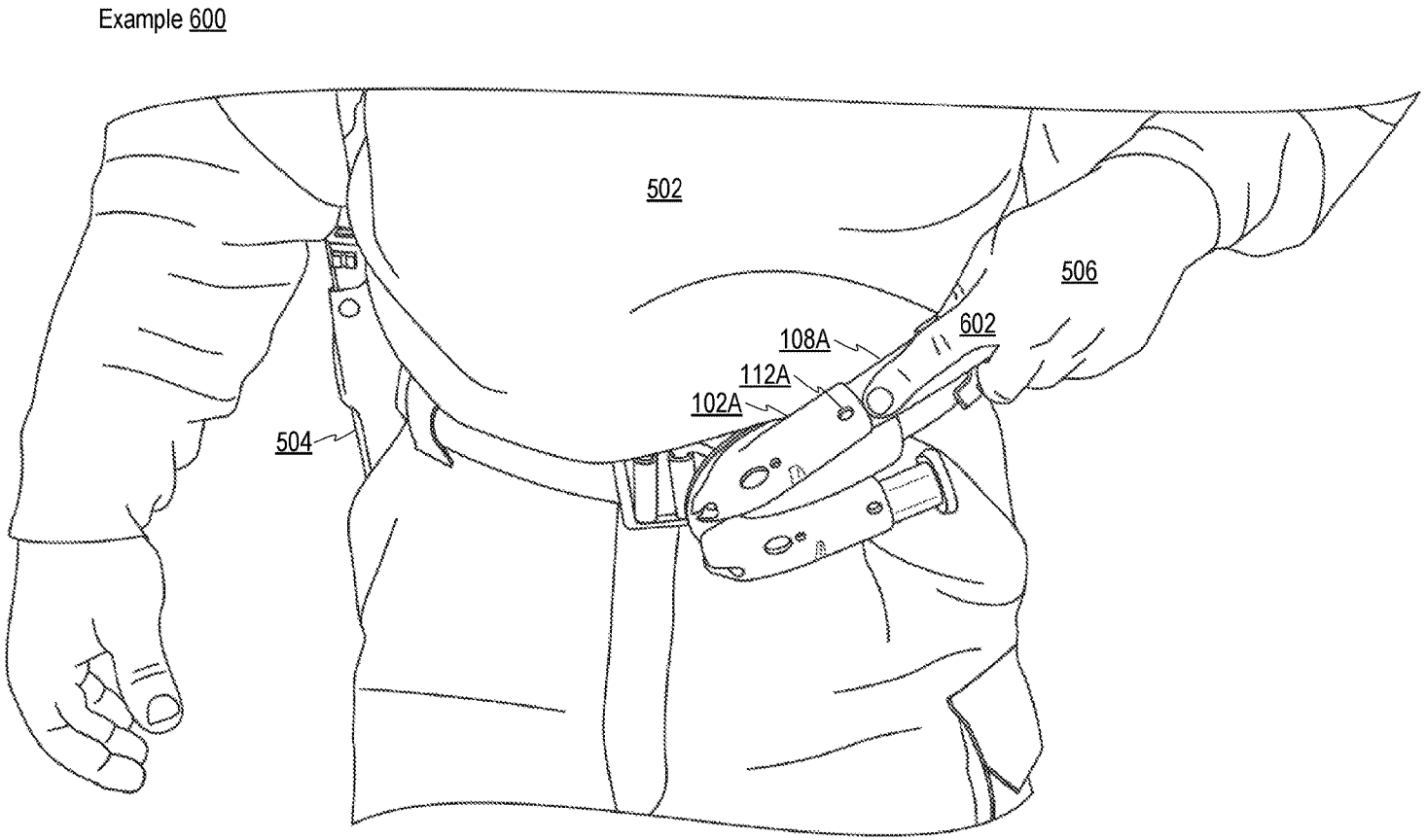
FIG. 6 illustrates a second utilization example including proper indexing in accordance with at least one embodiment of the present disclosure.

Schematic 202 demonstrates key angles that may be considered when receptacles 102A and 102B are coupled to base 104. Lengthwise dimension 206A may correspond to receptacle 102A and lengthwise dimension 206B may correspond to receptacle 102B. In an embodiment where device 100 comprises at attachment 106 to allow for belt-mounting, dimension 208 may correspond substantially to a beltline of a user wearing device 100. An example of operation is disclosed in FIGS. 5 and 6 showing a user wearing device 100 on a belt, and thus, beltline 208 may coincide with the belt of the user shown in FIGS. 5 and 6. Receptacle 102A may be coupled to base 104 so that receptacle 102A is arranged at an angle 210A above the beltline of a user. In at least one example implementation, angle 210A may be approximately forty (40) degrees. In at least one embodiment, receptacle 102A may be considered to be positioned in an "ergonomic grab position." As will be discussed in regard to FIGS. 5 and 6, angle 210A may cause receptacle 102A to be positioned so that exposed end 212A of magazine 108A may be arranged to point towards a direction from which the user will grasp the first firearm magazine. This arrangement may be ergonomic as the position of exposed end 212A may be arranged at a grasp position that naturally reflects the motion of the user's arm without having to contort in an uncomfortable or unusual manner, which could divert the user's focus from a target to which a firearm is directed.

Similarly, angle 210B reflects an angle created between lengthwise dimension 206B and beltline 208. In at least one embodiment, angle 210B may be smaller than angle 210A but may still be at or above beltline 208 to facilitate the ability of the user to ergonomically grasp exposed end 212B of magazine 108B. Consistent with the above example implementation, angle 210B may be approximately twenty (20) degrees. The difference between angles 210A and 210B is shown as angle 210C in FIG. 2. Given the above example angular measurements, angle 210C may be approximately twenty (20) degrees. In at least one embodiment, angle 210C may be formed between lengthwise dimensions 206A and 206B and may constitute substantially a "V-shape." The V-shape created by angle 210C may distance exposed end 212A from exposed end 212B and may make it easier for users with bigger fingers, gloved hands, etc. to locate each of exposed ends 212A and 212B. In this manner, users may be able to quickly and smoothly locate and remove each of magazines 108A and 108B for reloading a firearm without having to break eye contact with a target.

Figure 3:
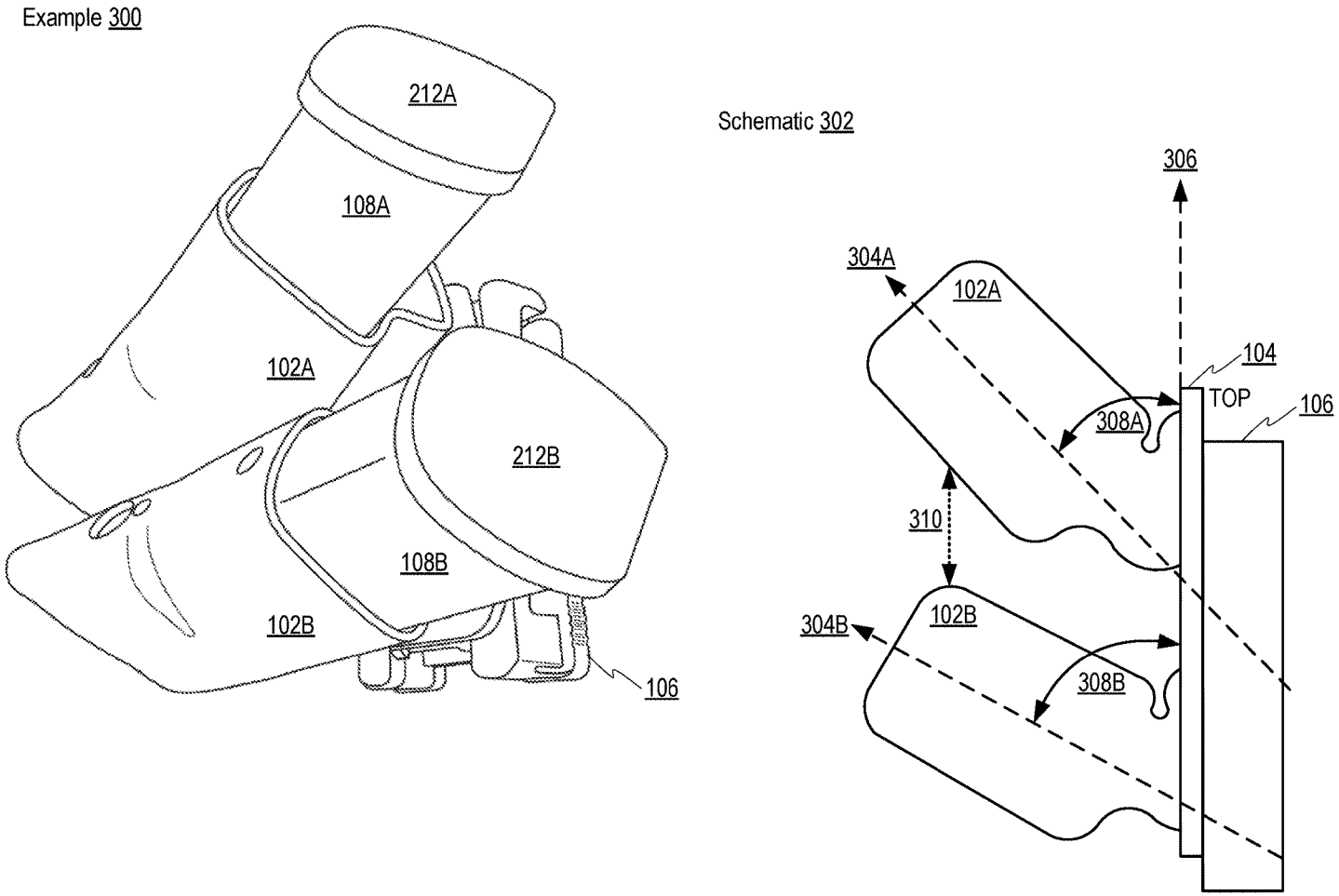
FIG. 3 illustrates an example front view of the carrier including exposed ends of firearm magazines in the carrier and a corresponding schematic diagram in accordance with at least one embodiment of the present disclosure.

FIG. 3 illustrates an example front view of the carrier including exposed ends of firearm magazines in the carrier and a corresponding schematic diagram in accordance with at least one embodiment of the present disclosure. Example 300 discloses a view of device 100 from the front (e.g., from the perspective of exposed ends 212A and 212B). Schematic 302 illustrates a second set of key angles that may be best comprehended from the front view. In schematic 302, widthwise dimension 304A may extend from where receptacle 102A joins to first surface 306 of device 100 (e.g., of base 104) to an opposing side of receptacle 102A. Widthwise dimension 304B may extend from where receptacle 102B joins to first surface 306 to an opposing side of receptacle 102B. Angle 308A may be an acute angle formed between widthwise dimension 304A and first surface 306 so that widthwise dimension 304A slants upward towards the top (e.g., "TOP" in FIG. 3) of device 100. In at least one example implementation, angle 308A may be approximately sixty (60) degrees. Angle 308A may position receptacle 102A to facilitate an improved alignment with a hand of a user reaching to withdraw magazine 108A, and thus, better indexing may result as will be described in regard to FIGS. 5 and 6. Angle 308B may be an acute angle formed between widthwise dimension 304B and first surface 306 so that widthwise dimension 304B slants in a direction substantially similar to that of widthwise dimension 304A. In at least one embodiment, angle 308B may be larger than angle 308A. For example, given the above example implementation angle 308B may be approximately seventy five (75) degrees. The larger size of angle 308B may still provide improved indexing but may also increase spacing 312 between receptacles 102A and 102B. Increased spacing 310 may allow users with larger fingers, gloved hands, etc. to more quickly and smoothly grasp exposed ends 212A and 212B for removing magazines 108A and 108B from receptacles 102A and 102B, respectively.

Figure 4:
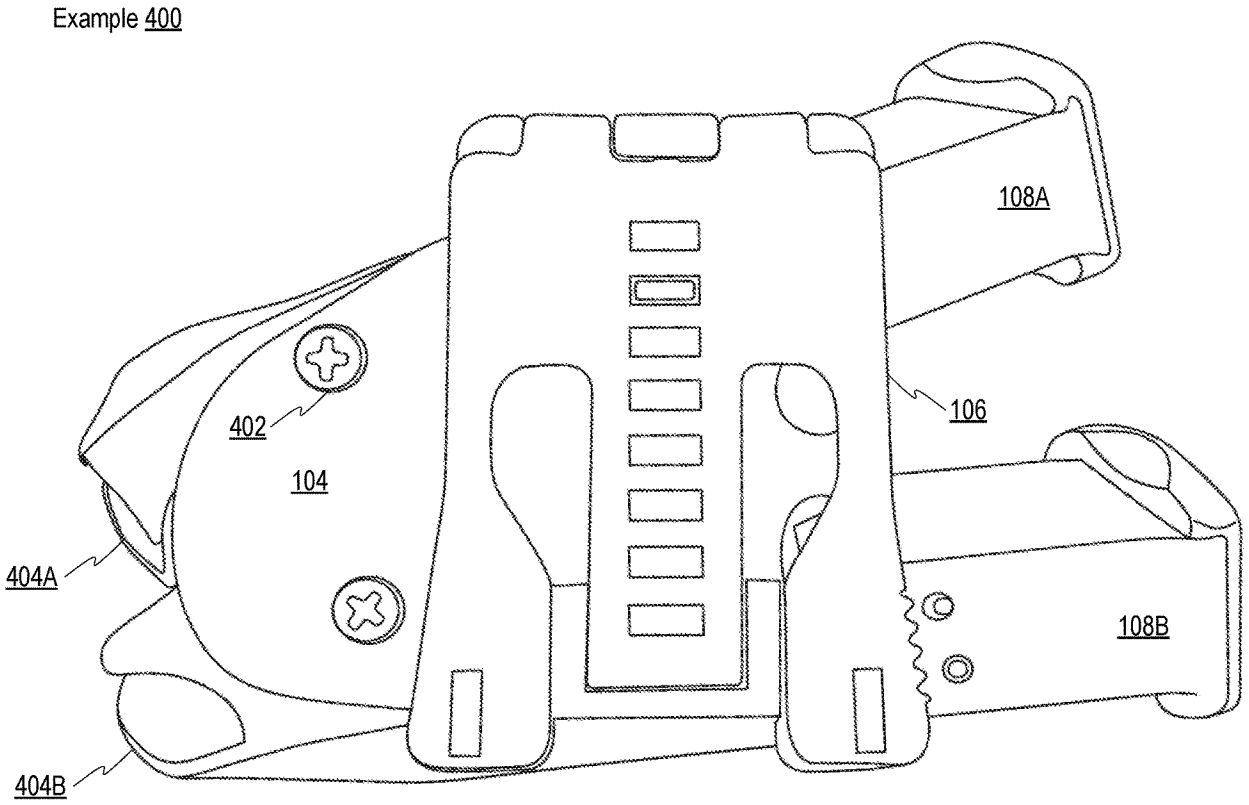
FIG. 4 illustrates an example rear view of the carrier comprising an example attachment in accordance with at least one embodiment of the present disclosure.

FIG. 4 illustrates an example rear view of the carrier comprising an example attachment in accordance with at least one embodiment of the present disclosure. Example 400 illustrates a rear view of device 100 including at least attachment 106. Attachment 106 is shown as a belt attachment in example 400, but also include other attachment types such as, but not limited to, harness attachments for special weapons and tactics (SWAT) or special operations personnel, pocket attachments, ankle attachments, thigh attachments, attachments for wearing under a suit jacket, vehicular attachments (e.g., to an automobile interior or motorcycle), etc. Example 400 also shows assembly via screws 402. While screw assembly is shown, other types of assembly may also be employed such as, but not limited to, heat bonding or fusing, gluing, nailing, riveting, stapling, sewing or stitching via thread or another similar connective material, etc. In at least one embodiment, trailing ends 404A and 404B of receptacles 102A and 102B, respectively, may be open (e.g., unsealed) as illustrated in FIG. 4. Leaving trailing ends 404A and 404B open may allow dust, dirt and other detritus to naturally fall out of receptacles 102A and 102B during use. Alternatively, trailing ends 404A and 404B may be closed (e.g., sealed) to, for example, provide moisture protection, more secure retention, etc. for firearms magazines 108A and 108B.

FIG. 5 illustrates a first utilization example in accordance with at least one embodiment of the present disclosure. Example 500 shows device 100 being worn by example user 502 (e.g., a policeman) in a beltline configuration. For reference, user 502 is also equipped with firearm 504 in a hip holster configuration. Indexing, as referenced herein, may comprise the practice of ensuring that hand 506 of user 502 is positioned optimally to extract a magazine (e.g., magazine 108A) from device 100 and insert magazine 108A into firearm 504 in not more than two quick and fluid motions. When hand 506 is properly indexed during extraction of magazine 108A from receptacle 108A the orientation of magazine 108A is known, and thus, there is no need for user avert concentration from a target towards which firearm 504 may be pointed during reloading. Any disruption in aim caused by reloading may be minimized with practice, improving the accuracy of user 502 when discharging firearm 504. Good indexing may be practiced and then maintained through the use of indexing features 112A. As will be shown in FIG. 6, indexing features 112A may help user 502 to learn good indexing and maintain good indexing practices.

FIG. 6 illustrates a second utilization example including proper indexing in accordance with at least one embodiment of the present disclosure. As shown in example 600, user 502 is extracting magazine 108A from receptacle 102A. As a first part of this operation, user 502 may reach for magazine 108A with their hand 506. Index finger 602 of user 502 may then come into contact with indexing features 112A. In at least one embodiment, indexing features 112A may provide a tactile reminder to user 502 to practice good indexing. For example, touching indexing features 112A may remind user 502 to place index finger 602 along the front surface of magazine 108A during extraction from receptacle 102A. If practiced correctly, the user's finger on the front surface of magazine 108A may place magazine 108A in an optimal position within hand 506 to then insert magazine 108A into firearm 504. In at least one embodiment, indexing features 112A may be employed as a training aid for instructing user 502 about proper indexing. Moreover, following instruction indexing features 112A may serve as an unconscious reminder for proper indexing, especially in high pressure (e.g., crisis) situations where user 502 may not be able to remain consciously aware of what constitutes proper indexing. In such a situation, "feeling" indexing features 112A may be able to trigger good behavior without thinking about it.

As used in this application and in the claims, a list of items joined by the term "and/or" can mean any combination of the listed items. For example, the phrase "A, B and/or C" can mean A; B; C; A and B; A and C; B and C; or A, B and C. As used in this application and in the claims, a list of items joined by the term "at least one of" can mean any combination of the listed terms. For example, the phrases "at least one of A, B or C" can mean A; B; C; A and B; A and C; B and C; or A, B and C.

Thus, this disclosure is directed to an ergonomic carrier for firearm magazines. An example device may comprise at least first receptacle to receive a first firearm magazine and a second receptacle to receive a second firearm magazine. The first receptacle may include a first lengthwise dimension and may be arranged at a first angle rotated around the first lengthwise dimension. The second receptacle may include a second lengthwise dimension and may be arranged at a second angle formed between the first lengthwise dimension and the second lengthwise dimension, and at a third angle rotated around the second lengthwise dimension. In at least one embodiment, the first and second receptacles may further include retention features to retain the first and second firearm magazines and/or indexing features to train and/or remind a user regarding proper indexing. The device may further include an attachment so that it may be worn by the user.

The following examples pertain to further embodiments. The following examples of the present disclosure may comprise subject material such as a device, components, methodologies and applications pertaining to an ergonomic carrier for firearm magazines, as provided below.

According to example 1 there is provided a device for carrying a firearm magazine. The device may comprise a first receptacle to receive a first firearm magazine, a second receptacle to receive a second firearm magazine, wherein the first receptacle includes a first lengthwise dimension and is arranged at a first angle rotated around the first lengthwise dimension, and wherein the second receptacle includes a second lengthwise dimension and is arranged at a second angle formed between the first lengthwise dimension and the second lengthwise dimension and at a third angle rotated around the second lengthwise dimension.

Example 2 may include the elements of example 1, wherein the first angle is an angle formed between a first widthwise dimension of the first receptacle and a surface of the device where the first receptacle joins the device, the first angle causing the first widthwise dimension to slant towards the top of the device.

Example 3 may include the elements of any of examples 1 to 2, wherein the third angle is an angle larger than the first angle formed between a second widthwise dimension of the second receptacle and a surface of the device where the second receptacle joins the device, the third angle causing the second widthwise dimension to slant towards the top of the device.

Example 4 may include the elements of any of examples 1 to 3, wherein the second angle causes the first and second receptacles to be arranged lengthwise to form a V-shape so that exposed ends of the first and second firearm magazines are separated by a certain distance at an open end of the V-shape.

Example 5 may include the elements of any of examples 1 to 4, further comprising an attachment to allow the device to be worn by a user.

Example 6 may include the elements of example 5, wherein the attachment is a belt attachment and the device is situated at a beltline of the user when worn.

Example 7 may include the elements of example 6, wherein the first receptacle is arranged at a fourth angle formed between the first lengthwise dimension and the beltline so that an exposed end of the first firearm magazine in the first receptacle points in a direction above the beltline.

Example 8 may include the elements of example 7, wherein the direction to which the exposed end of the first firearm magazine points is a direction from which the user will grasp the first firearm magazine.

Example 9 may include the elements of any of examples 7 to 8, wherein the second receptacle is arranged at a fifth angle smaller than the fourth angle formed between the second lengthwise dimension and the beltline so that an exposed end of the second firearm magazine in the second receptacle points in a direction substantially parallel to or above the beltline.

Example 10 may include the elements of any of examples 1 to 9, wherein the first and second receptacles comprise retention features to retain the first and second firearm magazines, respectively.

Example 11 may include the elements of example 10, wherein the retention features comprise at least indentations formed in the first and second receptacles configured to mate with indentations formed in the surface of the first and second firearm magazines, respectively.

Example 12 may include the elements of any of examples 10 to 11, wherein the retention features comprise at least a material applied to an interior surface of each of the first and second receptacles to impart a frictional force for retaining the first and second firearm magazines, respectively.

Example 13 may include the elements of any of examples 1 to 12, wherein the first and second receptacles comprise at least indexing features.

Example 14 may include the elements of example 13, wherein the indexing features are to remind a user of at least one of proper finger position or hand position when withdrawing either of the first or second firearm magazines from the first or second receptacles, respectively.

Example 15 may include the elements of example 14, wherein the indexing features provide tactile feedback to the user.

Example 16 may include the elements of any of examples 14 to 15, wherein the indexing features comprise at least holes formed in the surface of each of the first and second receptacles. Example 17 may include the elements of any of examples 14 to 16, wherein the indexing features comprise at least a ridge formed in the surface of each of the first and second receptacles.

Example 18 may include the elements of any of examples 1 to 17, further comprising at least a third receptacle to receive a third firearm magazine.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed:

1. A device for carrying a firearm magazine, comprising:

a first receptacle to receive a first firearm magazine, the first receptacle including a first longitudinal axis;

a second receptacle to receive a second firearm magazine, the second receptacle including a second longitudinal axis;

a base to which the first receptacle and the second receptacle are coupled, wherein:

the first receptacle is rotated around the first longitudinal axis to cause the first receptacle to slant away from the base at a first acute angle;

the first longitudinal axis and the second longitudinal axis are separated by a second acute angle;

the second receptacle is rotated around the second longitudinal axis to cause the second receptacle to slant away from the base at a third acute angle greater than the first acute angle; and the first and second receptacles are not totally coplanar with the base.

2. The device of claim 1, wherein the first acute angle is an angle formed between the first receptacle and the base where the first receptacle is coupled to the device, the first acute angle causing the first receptacle to slant towards the top of the device.

3. The device of claim 2, wherein the third acute angle is an angle formed between the second receptacle and the base where the second receptacle is coupled to the device, the third acute angle causing the second receptacle to slant towards the top of the device.

4. The device of claim 1, wherein the second acute angle causes the first and second receptacles to be arranged to form a V-shape so that ends of the first and second receptacles that receive the first and second firearm magazines, respectively, are separated by a certain distance at an open end of the V-shape.

5. The device of claim 1, further comprising an attachment to allow the device to be worn by a user.

6. The device of claim 5, wherein the attachment is a belt attachment and the device is situated at a beltline of the user when worn.

7. The device of claim 6, wherein the first receptacle is arranged at a fourth acute angle formed between the first longitudinal axis and the beltline so that an exposed end of the first firearm magazine in the first receptacle points in a direction above the beltline.

8. The device of claim 7, wherein the direction to which the exposed end of the first firearm magazine points is a direction from which the user will grasp the first firearm magazine.

9. The device of claim 7, wherein the second receptacle is arranged at a fifth acute angle formed between the first longitudinal axis and the beltline so that an exposed end of the second firearm magazine in the second receptacle points in a direction parallel to or above the beltline.

10. The device of claim 1, wherein the first and second receptacles comprise retention features to retain the first and second firearm magazines, respectively.

11. The device of claim 10, wherein the retention features comprise at least indentations formed in the first and second receptacles, the retention features formed in the first and second receptacles being configured to mate with indentations formed in the surface of the first and second firearm magazines, respectively.

12. The device of claim 10, wherein the retention features comprise at least a material applied to an interior surface of each of the first and second receptacles to impart a frictional force for retaining the first and second firearm magazines, respectively.

13. The device of claim 1, wherein the first and second receptacles comprise at least indexing features to guide a user's hand when accessing the first or second receptacle.

14. The device of claim 13, wherein the indexing features are to remind the user of at least one of proper finger position or hand position when withdrawing either of the first or second firearm magazines from the first or second receptacles, respectively.

15. The device of claim 14, wherein the indexing features provide tactile feedback to the user, the tactile feedback indicating to the user that the finger or hand position of the user is correct to withdraw the first or second firearm magazines without the user having to make eye contact with the first or second firearm magazines.

16. The device of claim 14, wherein the indexing features comprise at least holes formed in the surface of each of the first and second receptacles.

17. The device of claim 14, wherein the indexing features comprise at least a ridge formed in the surface of each of the first and second receptacles.

18. The device of claim 1, further comprising at least a third receptacle to receive a third firearm magazine.

* * * * *